US007675431B1

(12) United States Patent
Caouette, Sr.

(10) Patent No.: US 7,675,431 B1
(45) Date of Patent: Mar. 9, 2010

(54) EMERGENCY VEHICLE ALERT SYSTEM

(76) Inventor: James Caouette, Sr., P.O. Box 903115, Palmdale, CA (US) 93590

( * ) Notice: Subject to any disclaimer, the term of this patent is extended or adjusted under 35 U.S.C. 154(b) by 0 days.

(21) Appl. No.: 12/381,621

(22) Filed: Mar. 13, 2009

(51) Int. Cl.
*G08G 1/00* (2006.01)

(52) U.S. Cl. ..... 340/902; 340/906; 367/199; 381/56

(58) Field of Classification Search ..... 340/902–906, 340/825.72, 933; 367/93, 199; 381/56
See application file for complete search history.

(56) References Cited

U.S. PATENT DOCUMENTS 3,997,868 A * 12/1976 Ribnick et al. ..... 340/902
5,287,411 A * 2/1994 Hill et al. ..... 704/231
6,133,849 A * 10/2000 McConnell et al. .... 340/825.72
6,362,749 B1 * 3/2002 Brill ..... 340/902
6,958,707 B1 * 10/2005 Siegel ..... 340/902
6,980,125 B1 * 12/2005 Barber ..... 340/917
7,245,232 B1 * 7/2007 Caouette, Sr. ..... 340/933

* cited by examiner

*Primary Examiner*—Brent Swarthout
(74) *Attorney, Agent, or Firm*—Dennis W. Beech

(57) ABSTRACT

The present invention may be used for detecting sound frequency signals emitted by warning devices of emergency vehicles. A sensor may sense a selected frequency signal spectrum and may be in communication with an initial detection stage to detect a frequency of approximately 600 Hz and approximately 1400 Hz within a specific time interval. A signal identification stage may be in communication with said initial detection stage and may have a digital signal processor programmed to identify a wail and yelp warning signal to compare said warning signal to a histogram stored in a memory to estimate the distance from the sound frequency signal. The signal identification stage may be maintained in a power save mode until activated by said initial detection stage upon detection of a warning signal.

12 Claims, 7 Drawing Sheets

EMERGENCY VEHICLE ALERT SYSTEM

BACKGROUND OF THE INVENTION

This invention relates to apparatus for detection of selected sound frequency signals emitted by sirens of emergency vehicles. The new apparatus may detect a selected sound frequency signal spectrum emitted by various siren or warning sound sources in an initial detection stage. When a warning sound may be detected, a signal identification stage may determine the sound signal characteristics and estimate the distance to the warning sound source.

Various types of emergency vehicle siren detection systems may be currently known that may tend to be complicated, overly elaborate or use a lot of electric power. Less complicated devices, for example, that disclosed in U.S. Pat. No. 7,245,232, issued on Jun. 17, 2007, and herein incorporated by reference, may be known. However, this type of apparatus may be susceptible to false detection of sounds thought to be warning signals. To achieve a balance for a lower power system that may not be overly complicated, a system may be needed that uses a lower power, simple warning signal detection stage with a power save signal identification stage that only has full power applied once a sound warning signal has been detected.

SUMMARY OF THE INVENTION

The present invention is directed to apparatus for detecting sound frequency signals emitted by warning devices of emergency vehicles. A sensor may sense a selected frequency signal spectrum and may be in communication with an initial detection stage to detect a frequency of approximately 600 Hz and approximately 1400 Hz within a specific time interval. A signal identification stage may be in communication with said initial detection stage and may have a digital signal processor programmed to identify a wail and yelp warning signal to compare said warning signal to a histogram stored in a memory to estimate the distance from the sound frequency signal. The signal identification stage may be maintained in a power save mode until activated by said initial detection stage upon detection of a warning signal.

These and other features, aspects and advantages of the present invention will become better understood with reference to the following drawings, description and claims.

DETAILED DESCRIPTION

Figure 1:
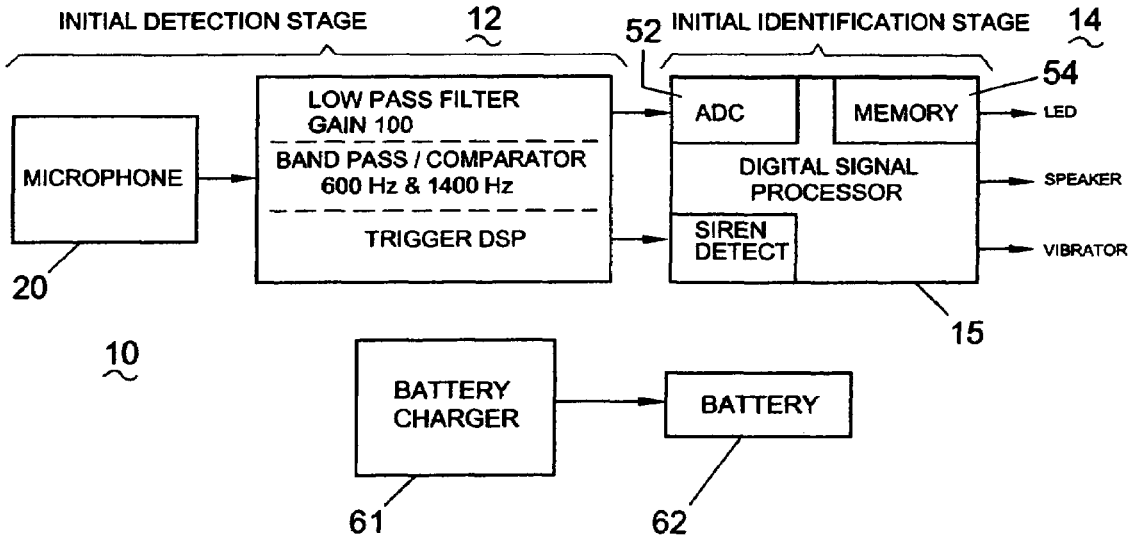
FIG. 1 illustrates a functional block diagram of a system according to an embodiment of the invention.

The following detailed description represents the best currently contemplated modes for carrying out the invention.

The description is not to be taken in a limiting sense, but is made merely for the purpose of illustrating the general principles of the invention.

Referring to FIGS. 1 through 4, an emergency vehicle alert system 10 may have an initial siren sound detection stage 12 that may be a low power consumption element and a signal identification or confirmation stage 14 that may require more power for operation. The initial stage 12 for siren sound detection may have a microphone 20, that may be a condenser microphone requiring low power that may be in communication with a low pass filter 22 and gain amplifier 24 set at a cut-off frequency to reduce interfering signals and to produce sufficient signal strength for processing of siren audio frequency signals. The gain output signal 25 of the gain amplifier 24 may be communicated to two band pass filters 26, 28 with each in communication with a comparator 30, 32 to function as part of the initial siren sound detection stage 12.

The gain output signal 25 may also be communicated to a digital signal processor 50 that may normally be in a power save or sleep mode unless signaled by the initial stage 12 that a siren sound has been detected. The comparators 30, 32 may communicate siren frequency detection to trigger devices 34, 36 to signal the digital signal processor 50 that a siren signal has been detected.

Figure 2:
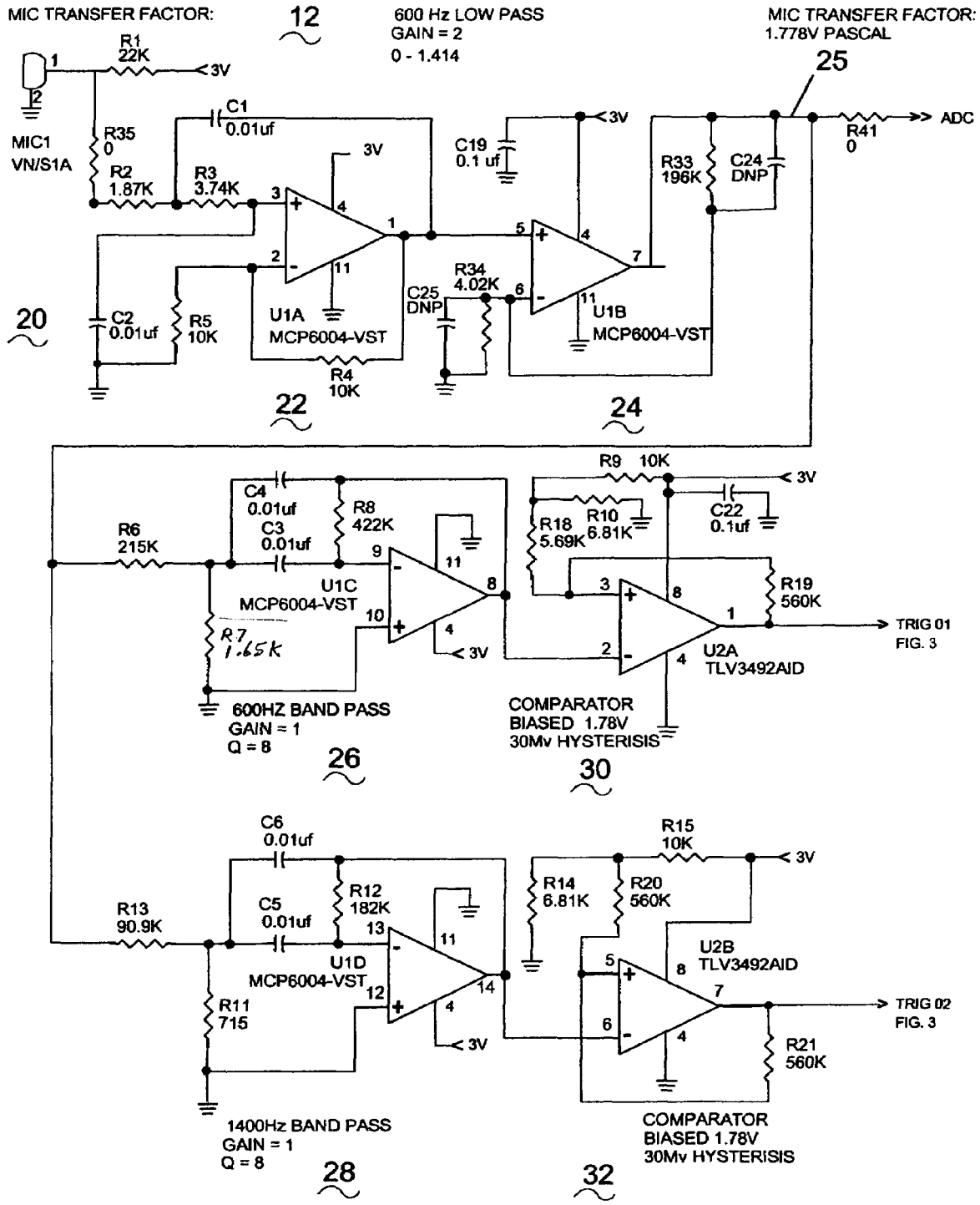
FIG. 2 illustrates a schematic of an initial detection stage according to an embodiment of the invention.
Figures 1, 3:
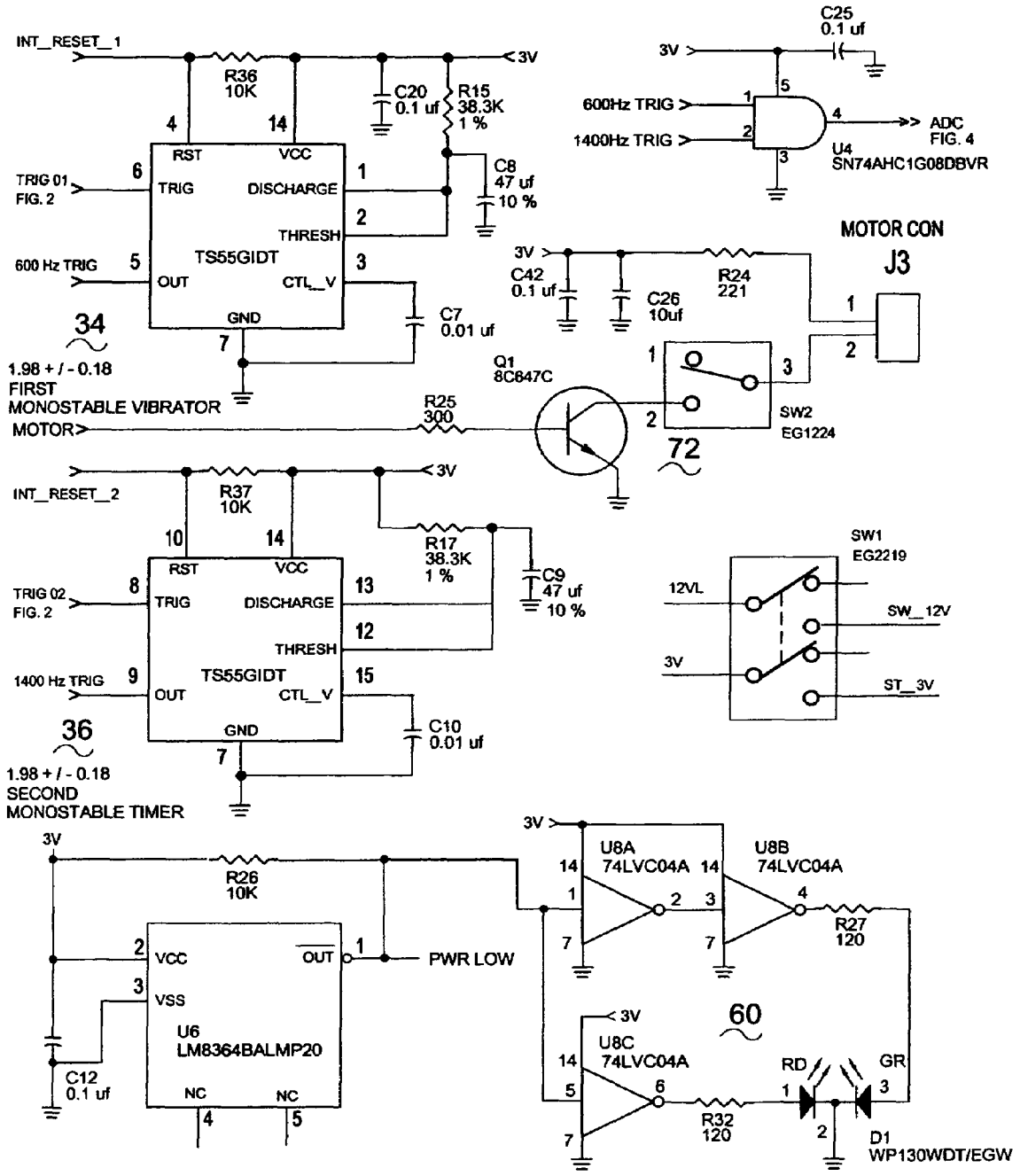
FIG. 3 illustrates a schematic of a signal identification stage according to an embodiment of the invention.
Figures 1, 4:
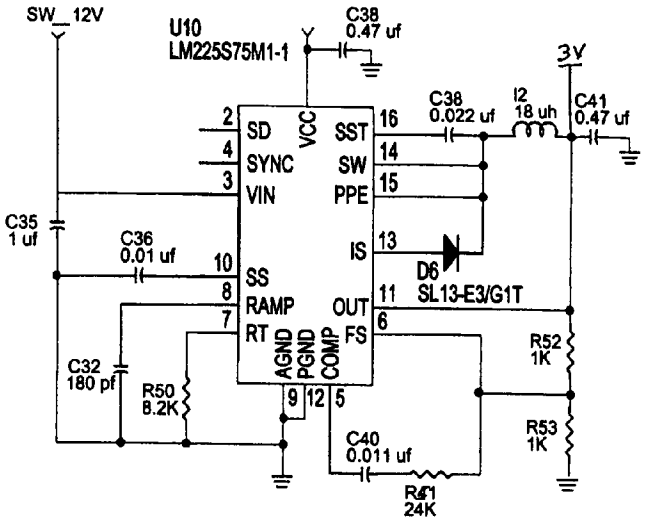
FIG. 4 illustrates a schematic of peripheral elements for a system according to an embodiment of the invention.
Figures 2, 4:
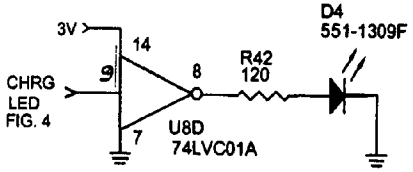
Figures 2, 3:
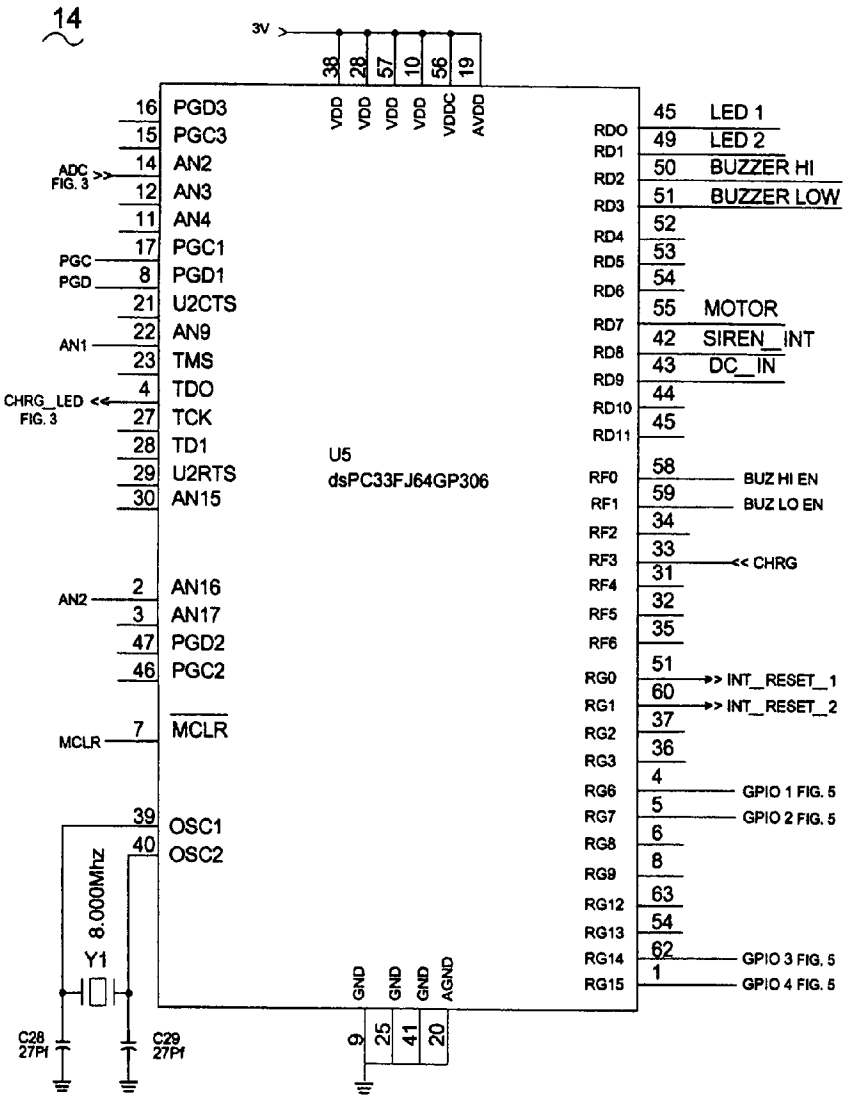
Figures 3, 4:
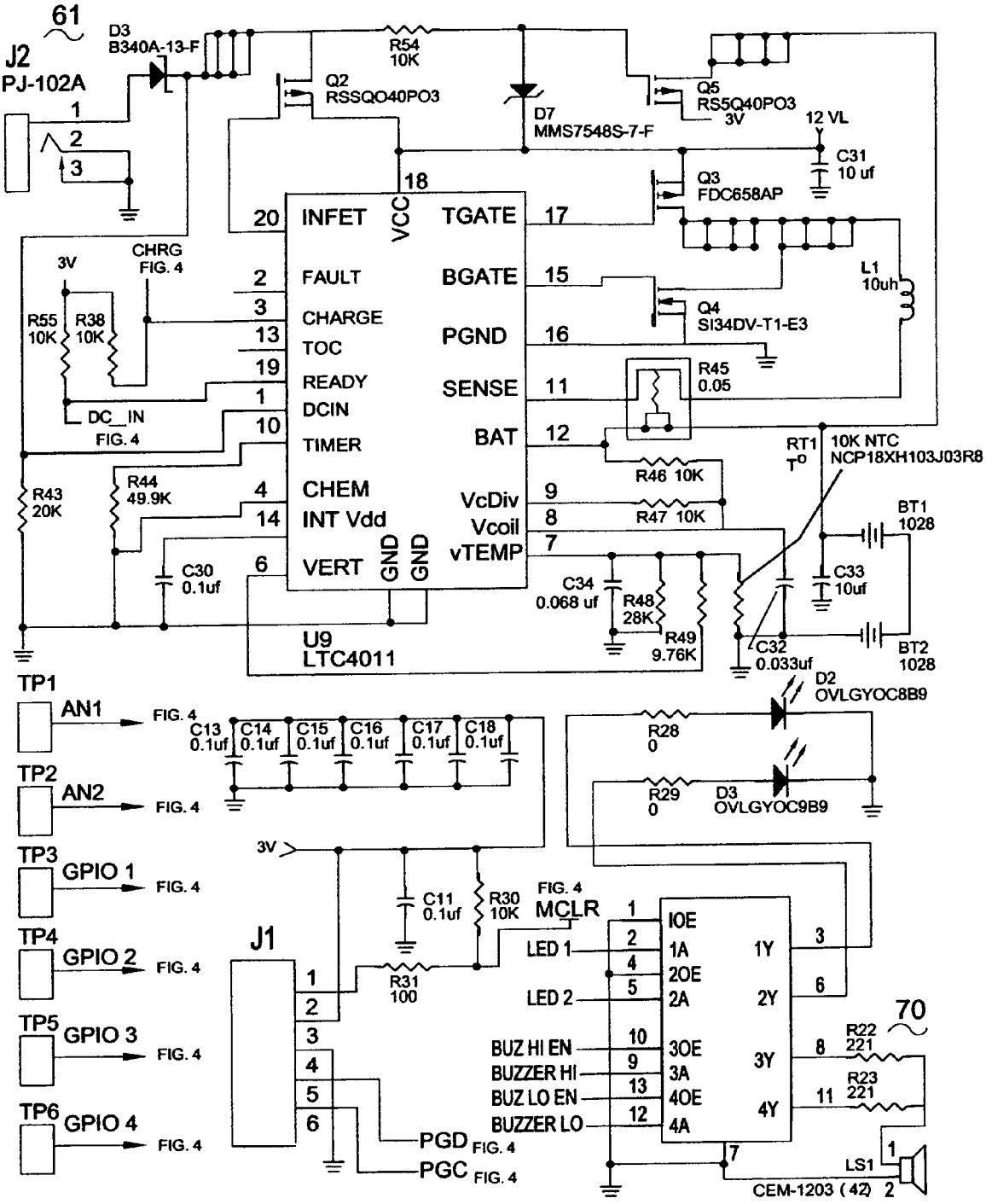

The microphone 20, low pass filter 22, gain amplifier 24, band pass filters 26, 28, comparators 30, 32, and trigger devices 34, 36 may be relatively low power consumption devices as compared to a digital signal processor 50 and may be connected as illustrated in the example circuit of FIG. 2. Given the three most recognized guidelines and regulations for emergency vehicles and several manufactures of siren apparatus it appears that many sirens produce sounds in a frequency range of 100 Hz to 3000 Hz. Microphones with frequency sensitive range greater than the sound range may be available with a sensitivity of −42 dB to provide sufficient resolution for analog-to-digital converters (ADC) and may require current usage of less than 0.5 mA. Given the sound frequency range of interest the low pass filter 22 cut off frequency may be set at 3000 Hz.

Figure 5:
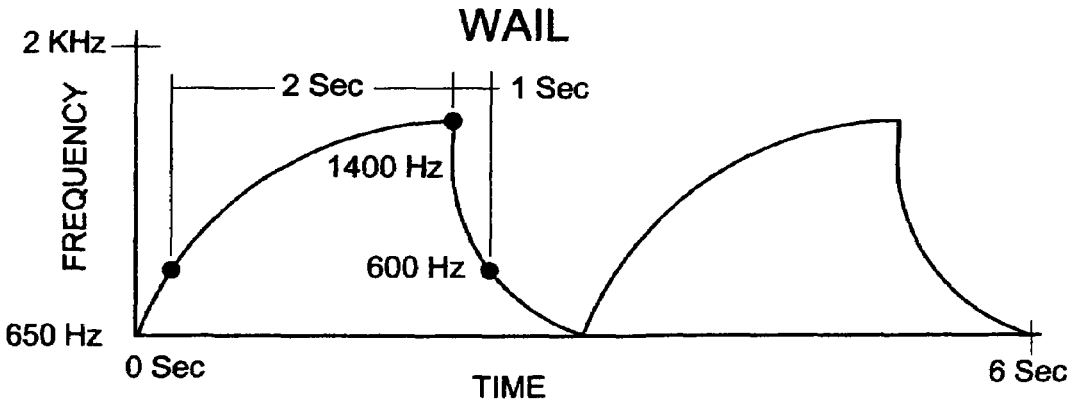
FIG. 5 illustrates a generic wave form of a warning signal according to an embodiment of the invention.

The band pass filters 26, 28 may be set to detect a siren sound frequency using a center band frequency of 600 Hz and 1400 Hz respectively with a timed detection separation for each frequency component. With reference to FIG. 5, a generic wave form for a siren wail sound is illustrated. The band pass filter 26 may detect a signal frequency centered at 600 Hz and start a timer for the band pass filter 28 to detect a signal frequency centered at 1400 Hz that if not detected by comparators 30, 32 will not activate trigger devices 34, 36 to activate the digital signal processor 50. If further reduction of false detection may be desired, a second detection of the lower frequency 600 Hz by the band pass filter 26 may be implemented using a second timed detection constraint as illustrated in FIG. 5.

If the initial stage 12 detects a siren sound and trigger devices 34, 36 are set, the digital signal processor 50 may be activated by communication from AND gate 38 to transition from a power save mode to process the gain output signal 25. The digital signal processor 50 may have an analog-to-digital converter 52 as part of the device, may sample the gain output signal 25, and may decode the frequency and amplitude patterns using fast fourier transform processing to more accurately determine whether the signal is a siren sound based signal. This processing may be done with a software program stored in a memory 54 of the digital signal processor 50.

In addition to identifying a siren sound it may be useful to identify how far away the siren sound source may be located. Depending on the microphone 20 characteristics and low pass filter 22 with gain filter 24 a minimum amplitude level signal that may be processed by the digital signal processor 50 may be determined. Using this as a maximum distance baseline for a siren sound identification that may be determined by testing the device, the digital signal processor 50 may be programmed to extrapolate relative distances of a siren sound source based on the amplitude characteristics of a siren sound.

The digital signal processor 50 may have a 10 bit resolution analog-to-digital converter 52 and a 10 mips processing speed to process the siren sound frequency signal. A power save or stand by mode for the digital signal processor 50 to conserve power may be approximately in the microampere range. The digital signal processor 50 may also control the operation of a speaker 70, light emitting diodes and a motor 72 to warn a user of a detected siren sound. Buffering and amplification of digital signal processor 50 signals may be included to operate these devices. The sound, light and motor vibration characteristics may be controlled to indicate an approaching or receding siren sound, for example, increasing or decreasing the frequency of a flashing light.

Figure 6:
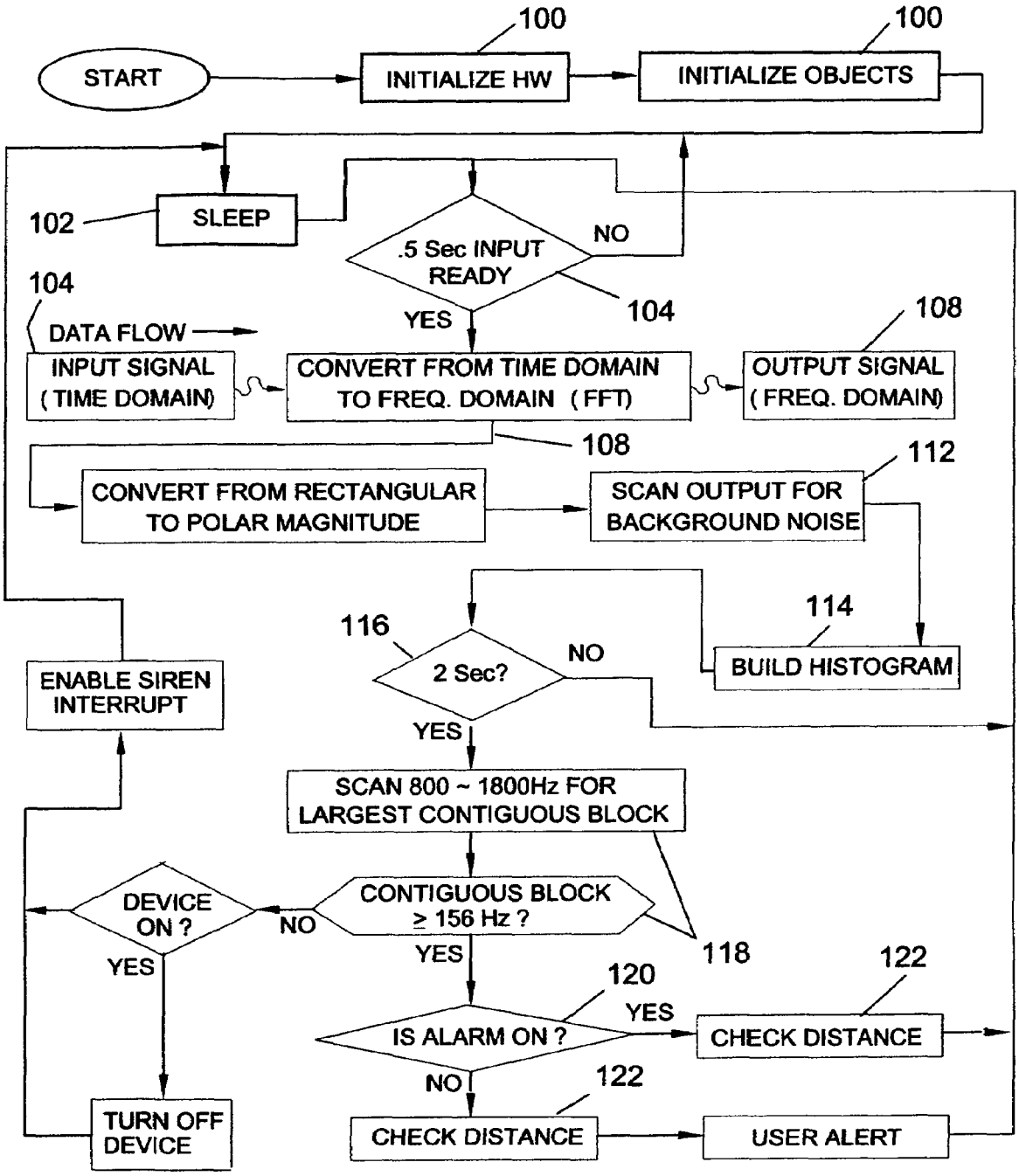
FIG. 6 illustrates a flow diagram of a stored program according to an embodiment of the invention.
Figure 7:
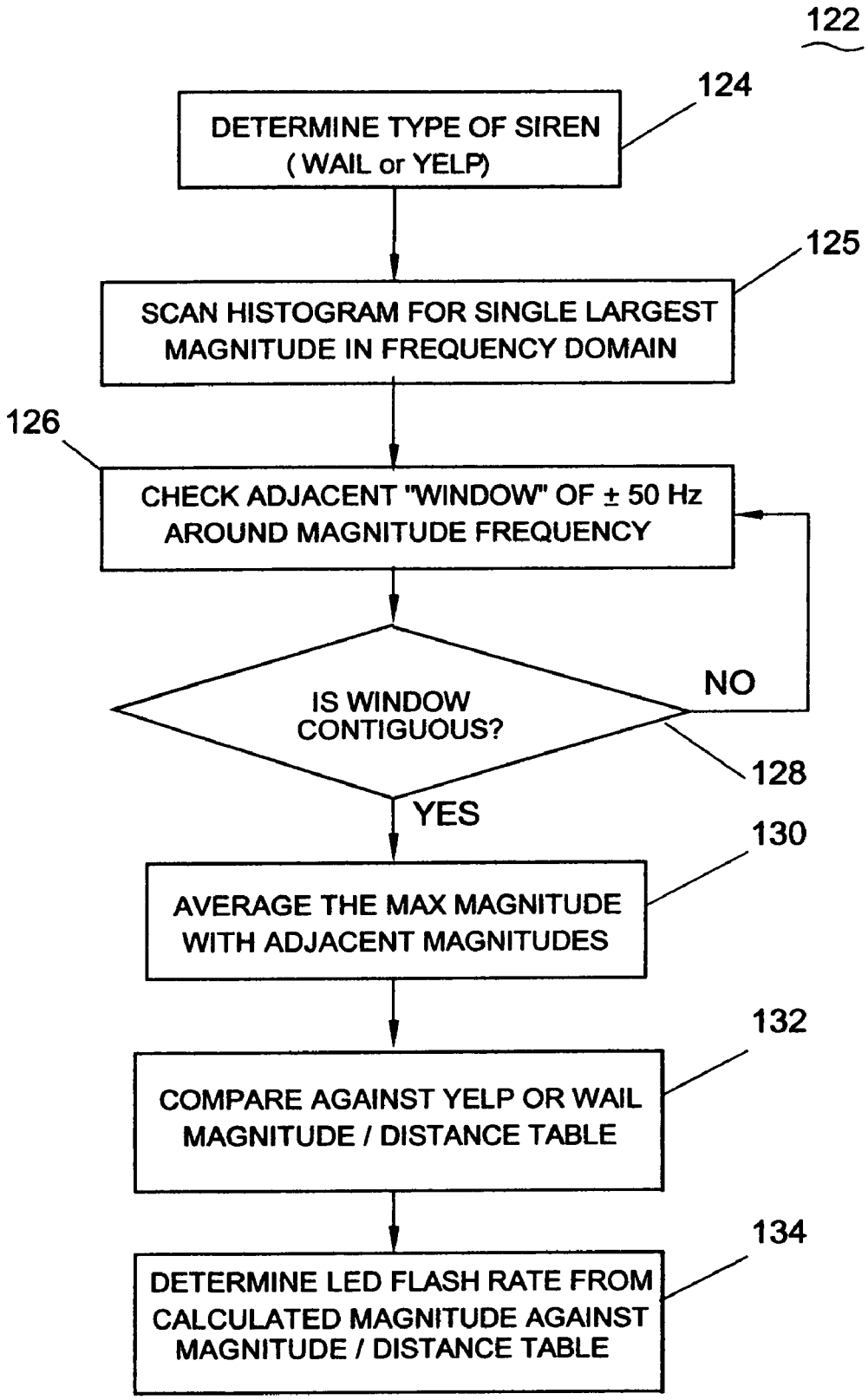
FIG. 7 illustrates a flow diagram of a stored program according to an embodiment of the invention.

Referring to FIGS. 1, 6 and 7, in operation the emergency vehicle alert system 10 may operate as follows. When electrical power is applied the initial stage 12 may be activated for initial detection of a siren sound and the signal identification stage 14 may be initialized 100 and placed in a power save or sleep mode 102 until a siren sound may be detected by the initial stage 12. As described earlier the receipt of a trigger device signal may be detected by the digital signal processor 50 to activate and be controlled by a stored program. The gain output signal 25 may be sampled in 0.5 second increments 104 for processing by a fast fourier frequency transform algorithm 106 whose output 108 may be converted to polar coordinate 110 for further processing. The polar coordinate output signal representation may be scanned to filter out background noise 112 and the resulting scanned signal may be stored in the memory of the digital signal processor as a plot of sample data points in the form of a histogram 114. When 2.0 seconds 116 of sample data have been processed the 2.0 seconds buffer of data may be scanned on a first-in-last-out basis to identify the siren sound signal characteristics to compare to stored memory siren sound characteristics.

A siren wail or yelp sound may be characterized as a frequency modulated signal with a fixed amplitude. The siren emits sound with frequencies that are continuously contiguous. The digital signal processor 50 firmware may scan for contiguous blocks of 156 Hz frequency 118. Most sirens may emit frequencies between 800 Hz and 1800 Hz with contiguous blocks of frequencies between 900 Hz to 1056 Hz with a consistent amplitude being an example for which to search. The actual data captured for a siren sound may be much greater than the minimum 156 Hz selected based on the resolution of the sampling selected. One or more of the alarm indicators may be activated 120.

The distance from the siren source may be estimated 122. The signal characteristics of a siren wail and yelp are different because of the difference in cycle periods with a wail having a longer period than a yelp signal. Different comparison tables may be stored in the digital signal processor memory for comparison of a yelp or a wail signal to estimate distance to the siren sound source. The presence of a wail or yelp signal may be determined 124 and the histogram scanned for largest magnitude 125. Adjacent frequency magnitude, within approximately plus or minus 50 Hz, may be examined 126 to confirm contiguous signal 128. If the sample is contiguous, average the maximum magnitude with adjacent magnitudes 130 and compare to the stored magnitude/distance tables 132. Based on the distance to the siren source, the warning indicator repetition rate 134 may be controlled.

A battery monitoring 60 and charging circuit 61 with batteries 62 may be used to provide electric power to the unit. With an adapter, for example, a connector for an automobile power outlet socket, the emergency vehicle alert system 10 may be used in land vehicles. With battery 62 only power, the system 10 may be carried by a person or used in other situations where external power may not be available. The implementation of a low power initial detection stage 12 and power save mode signal identification stage 14 may allow for longer operation when battery 62 only operation is used.

While the invention has been particularly shown and described with respect to the illustrated embodiments thereof, it will be understood by those skilled in the art that the foregoing and other changes in form and details may be made therein without departing from the spirit and scope of the invention.

I claim:

1. An apparatus to detect a sound frequency signal emitted by a warning device of vehicles comprising:

a sensor to sense a selected sound frequency signal spectrum is in communication with an initial detection stage to detect a frequency of approximately 600 Hz and frequency of approximately 1400 Hz within a specified time interval;

a signal identification stage in communication with said initial detection stage wherein said signal identification stage has a digital signal processor programmed to identify a wail and a yelp warning signal and to compare said wail and said yelp warning signal to a histogram stored in a memory to estimate the distance from said sound frequency signal;

wherein said signal identification stage is placed in a power save mode on application of electrical power and is maintained in said power save mode until activated by said initial detection stage to process a gain output signal upon detection of said frequency of approximately 600 Hz and said frequency of approximately 1400 Hz within said specified time interval;

sampling said gain output signal in 0.5 second increments for processing by a fast fourier transform algorithm and for conversion to a polar coordinate output representation;

filtering the polar coordinate output representation for removal of background noise and storing the filtered signal in a memory in the form of a histogram;

scanning the stored histogram on a first-in-last-out basis and comparing the histogram to a siren sound characteristic signal stored in the memory to identify a siren sound; and a user warning indicator controlled by said digital signal processor and an electronic power source.

2. The apparatus as in claim 1 wherein said sensor is a microphone.

3. The apparatus as in claim 1 wherein said initial detection stage comprises:

a low pass filter with a cut off frequency of approximately 3000 Hz and a gain amplifier with a gain of approximately 50;

a first band pass filter set to detect a frequency at a center band of 600 Hz and a second band pass filter set to detect a frequency at a center band of 1400 Hz for an output signal received from said gain amplifier; and a first comparator in communication with said first band pass filter and a second comparator in communication with said second band pass filter to communicate to a first trigger device and a second trigger device the receipt of said center band of 600 Hz and said center band of 1400 Hz.

4. The apparatus as in claim 3 wherein said first comparator is in communication with a timing device to set said specified time interval for said second comparator to detect receipt of said center band of 1400 Hz.

5. The apparatus as in claim 3 wherein said initial detection stage elements are selected from minimum electric power electronic components.

6. The apparatus as in claim 2 wherein said microphone has a sensitivity of at least −42 dB and a current usage of less than 0.5 mA.

7. The apparatus as in claim 1 wherein said digital signal processor has an analog-to-digital converter with at least a 10 bit resolution and at least a 10 mips processing speed.

8. The apparatus as in claim 1 wherein said user warning device is selected from one of a light indicator, a motor vibrator and a speaker.

9. The apparatus as in claim 8 wherein said light indicator is at least two white light indicators connected to alternately light at a frequency controlled by said digital signal processor.

10. The apparatus as in claim 1 wherein said scanning is for contiguous blocks of a minimum of 156 Hz frequency.

11. The apparatus as in claim 1 wherein said detection further comprising:

scanning the stored histogram for the largest magnitude siren frequency signal;

scanning adjacent frequency signals within approximately plus or minus 50 Hz to confirm the contiguous signal;

averaging maximum magnitude with adjacent magnitudes if the contiguous signal is confirmed; and comparing the averaged magnitude signal to a stored set of tables of magnitude/distance to estimate a distance from the siren signal to the apparatus.

12. The apparatus as in claim 1 wherein said power source comprising a battery connected to a battery charger and a power charge status indicator.

* * * * *